United States Patent [19]

Kurtenbach

[11] Patent Number: 4,827,542

[45] Date of Patent: May 9, 1989

[54] INFLATABLE CONTAINER FOR A SMALL CHILD

[76] Inventor: Leonard F. Kurtenbach, 614-4th Street, SE., Weyburn, Saskatchewan, Canada, S4H 2G1

[21] Appl. No.: 179,992

[22] Filed: Apr. 11, 1988

[51] Int. Cl.[4] ..... A47D 7/02; A47D 13/06

[52] U.S. Cl. ..... 5/93 R; 5/94; 5/99 R

[58] Field of Search ..... 5/93 R, 93 B, 99 R, 5/99 B, 99 C, 94, 100; 383/3; 119/1, 2; 229/101, 103, 125, 171

[56] References Cited

U.S. PATENT DOCUMENTS

| | | | |
|---|---|---|---|
| 2,128,978 | 9/1938 | Akin . | |
| 2,247,598 | 7/1941 | Bohlen | 5/94 |
| 2,641,773 | 6/1953 | Kramer | 5/94 |
| 2,672,628 | 3/1954 | Spanel | 5/98 R |
| 3,018,492 | 1/1962 | Rosen . | |
| 3,049,728 | 8/1962 | Lund | 5/98 R |
| 3,137,870 | 6/1964 | Fink . | |
| 3,321,779 | 5/1967 | Kaufman et al. | 5/93 R |
| 3,323,147 | 6/1967 | Van Dean . | |
| 3,438,069 | 4/1967 | Long | 5/98 R |
| 3,513,489 | 5/1970 | Miller et al. | 5/94 |
| 3,579,673 | 5/1971 | Hirschey . | |
| 3,619,825 | 11/1971 | Taub . | |
| 3,653,710 | 4/1972 | Barnard | 296/39 R |
| 3,818,962 | 6/1974 | Muller et al. | 190/2 |
| 3,825,169 | 7/1974 | Meyers | 229/171 |
| 3,833,947 | 9/1974 | Sorensen . | |
| 3,931,652 | 1/1976 | Navarra | 4/177 |
| 4,003,098 | 1/1977 | Fink . | |
| 4,044,867 | 8/1977 | Fisher | 383/3 |
| 4,091,852 | 5/1978 | Jordan et al. | 383/3 |
| 4,232,415 | 11/1980 | Webber | 5/427 |
| 4,583,253 | 4/1986 | Hall | 5/94 |
| 4,670,923 | 6/1987 | Gabriel et al. | 5/424 |

FOREIGN PATENT DOCUMENTS

| | | | |
|---|---|---|---|
| 506995 | 11/1954 | Canada | 5/98 R |
| 2347526 | 4/1975 | Fed. Rep. of Germany | 5/99 C |

*Primary Examiner*—Alexander Grosz
*Assistant Examiner*—Eric K. Nicholson
*Attorney, Agent, or Firm*—Adrian D. Battison; Stanley G. Ade; Murray E. Thrift

[57] ABSTRACT

An inflatable container for use as a crib, playpen, bassinet and safety car bed is provided by a rectangular base and attached side walls, all of which can be inflated by an air pump permanently attached along the top of one side wall. Between adjacent edges of each side wall and the next side wall a zipper is provided which extends from the base to the top edge of the side wall so that when fully closed the side walls define a rectangular structure with open top. Across a center line of each side wall is a fold section which allows a top portion of the wall to fold back downwardly and attach to the base. Ballast pockets can be provided in the base. The device can be used in a vehicle with a strap system including an automatic retraction device whereby the straps on retraction draw down the upper sections of two walls to close the open top and contain the child.

13 Claims, 3 Drawing Sheets

INFLATABLE CONTAINER FOR A SMALL CHILD

BACKGROUND OF INVENTION

This invention relates to a container having inflatable walls for use as a car bed, crib, playpen and bassinet for a small child.

It has previously been proposed to form a crib or bassinet from plastics material having tubular formations which allow the walls of the crib or container to be inflated. This has a number of advantages in that the container can be collapsed for simple storage and transportation when not in use and, in addition, it forms a soft protective wall against which the small child or infant can fall without damage.

However, devices of this type have not been particularly successful in that they have had a number of disadvantages and design faults.

It is one object of the present invention, therefore, to provide an improved inflatable container of this type particularly which can be converted from a playpen to crib or bassinet and to a car bed which provides protection for the child in a car.

According to the invention, therefore, there is provided a container having inflatable walls for use as a car bed, crib, playpen and bassinet for a small child, the container comprising a rectangular base and four wall portions each attached to a respective edge of the base, releasable interconnecting means between adjacent edges of the wall portions, each wall portion having transverse fold means thereacross dividing a top section thereof from a bottom section adjacent the base whereby the top section can be folded down to lie alongside the bottom section and releasable interconnecting means between the top section and the base to hold said top section in said folded down position.

The interconnecting means at the edges of the walls can be provided preferably by zippers extending from the base to the top of the wall.

This has a number of advantages in that with the zippers joined part way along the wall, the top section of the wall can be folded over to lie at 180° to the bottom section and then be connected to the base to form a double wall. This arrangement enables the container to be converted from a playpen with high walls to a crib or bassinet with the double walls and also to the car bed where two of the walls are normally upstanding but can be pulled over to enclose an open top of the container by the action of retractable belts holding the bed in place on a seat of the car.

Further important aspects of the invention relate to the positioning of a permanently attached air pump for inflating the walls, the pump being attached along one top edge of a wall portion so that when deflated it can be rolled into the flat blank forming the container for storage. In addition, pockets for ballast can be provided in the base to provide stability for the container when inflated.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

Figure 1:
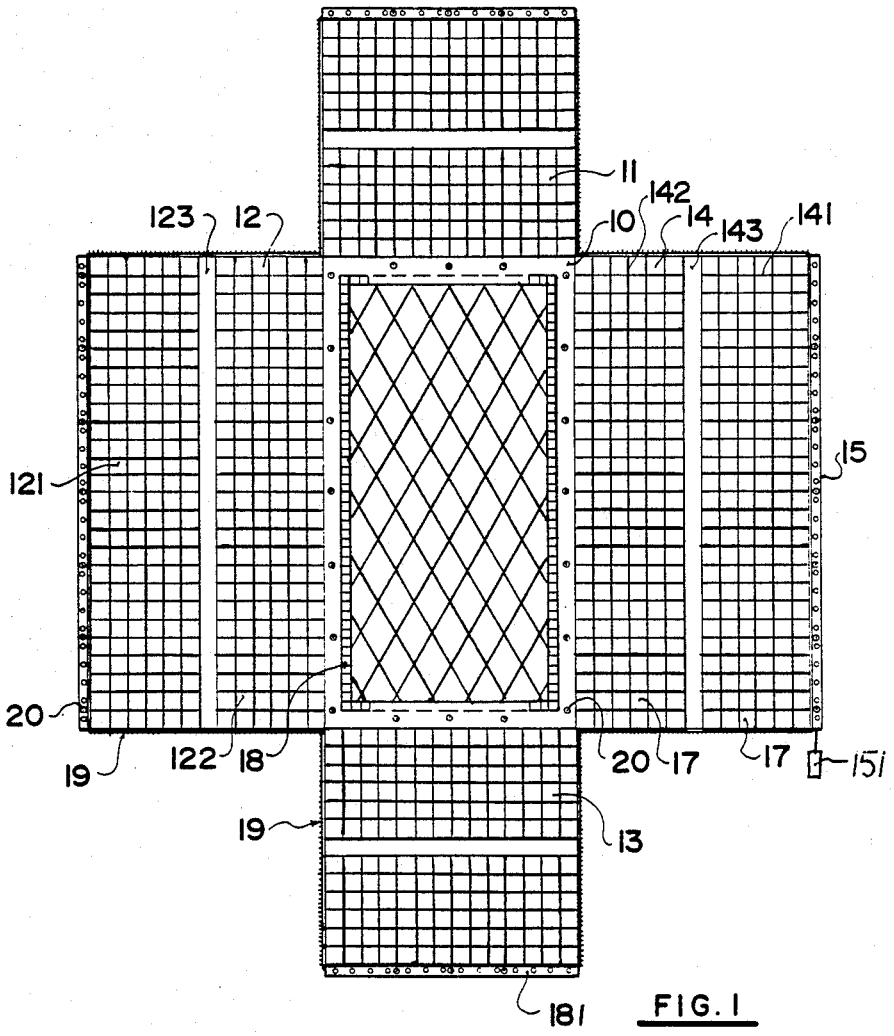
FIG. 1 is an underside view of the container according to the invention in deflated flat blank form.

Referring firstly to FIG. 1, the flat blank comprises a rectangular base 10 and four upstanding wall portions 11, 12, 13, 14. Each of the wall portions and the base is formed from tubular formations into which air can be injected from an air pump 15 in known manner. The tubular formations are defined by two separate layers of plastics material defining the flat blank with the layers sealed together at spaced lines indicated at 17.

A top tubular portion 181 is arranged along the top edge of each of the side walls except the side wall 14 where a tubular shaped air pump 15 is positioned of shape and size equal to the portions 181 and including a handle 151. The tubular portion 181 and the air pump are substantially the same in form of size and weight.

In the base on the underside around the periphery thereof is provided a number of pockets 18 into which ballast material, e.g. sand or water, can be inserted to provide a weighting of the base to improve the stability of the container when inflated.

In between adjacent edges of adjacent side walls there are provided zippers with the base of the zipper at the junction between the wall portions and the base of the blank so that the zippers can be closed in a conventional manner to a position joining the top edges of the adjacent side wall portions. The zippers are indicated generally at 19.

Figure 3:
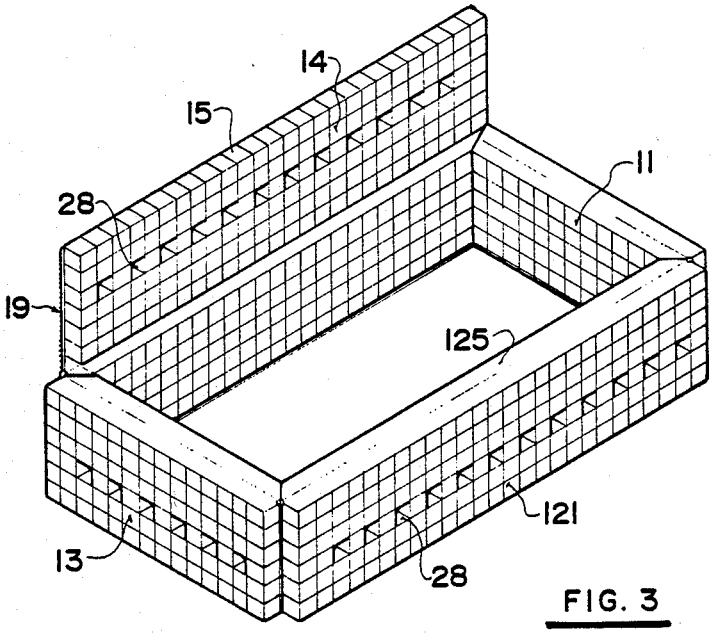
FIG. 3 is an isometric view showing the inflated blank from FIG. 1 in the form for a crib or bassinet.

Each of the wall portions is divided into an upper section and a lower section indicated at 121/141 and 122/142 in respect of the walls 12 and 14. In between these sections is a fold line 123/143 which is formed by a reduction in the size of the tubes so that air is still communicated to the tubes in the lower section from the tubes in the upper section but in view of the reduced amount of inflatable section within the fold line 123, the upper section 121 can be folded relative to the lower section 122 to the position illustrated in FIG. 3. In order to retain the wall sections in the folded condition illustrated in FIG. 3, a plurality of press fasteners 20 is provided around the periphery of the base and along the top edge of the wall portions so the press fasteners can be connected together to retain the walls in folded condition as illustrated in FIG. 3. The width of the fold section 123 is twice the width of the wall section, that is twice the diameter of the tubular portions forming the wall sections so as to allow the folding through 180°.

Figure 2:
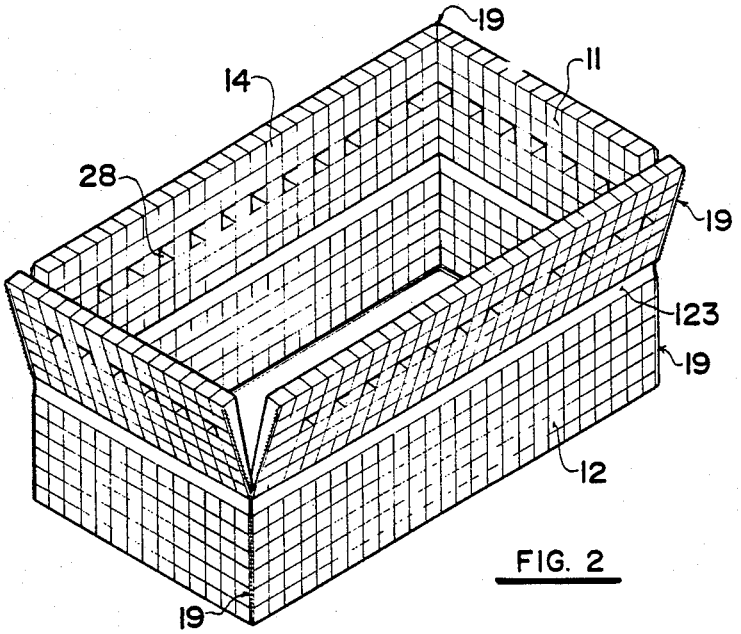
FIG. 2 is an isometric view of the inflated blank from FIG. 1 in partially assembled form to provide a crib or playpen.

In FIG. 2 one of the zippers 19 is shown closed to the top of the adjacent walls 11 and 14 with the remaining zippers closed only half way up the walls to the fold line 123. In order to complete the playpen or crib with high walls, the zippers 19 are all closed up to the top edges of the walls to form a rectangular box with open top.

The bassinet or crib shown in FIG. 3 has three of the walls folded down as previously explained, and this provides a double thickness wall which is particularly strong and resists compression or distortion of the container.

Figure 4:
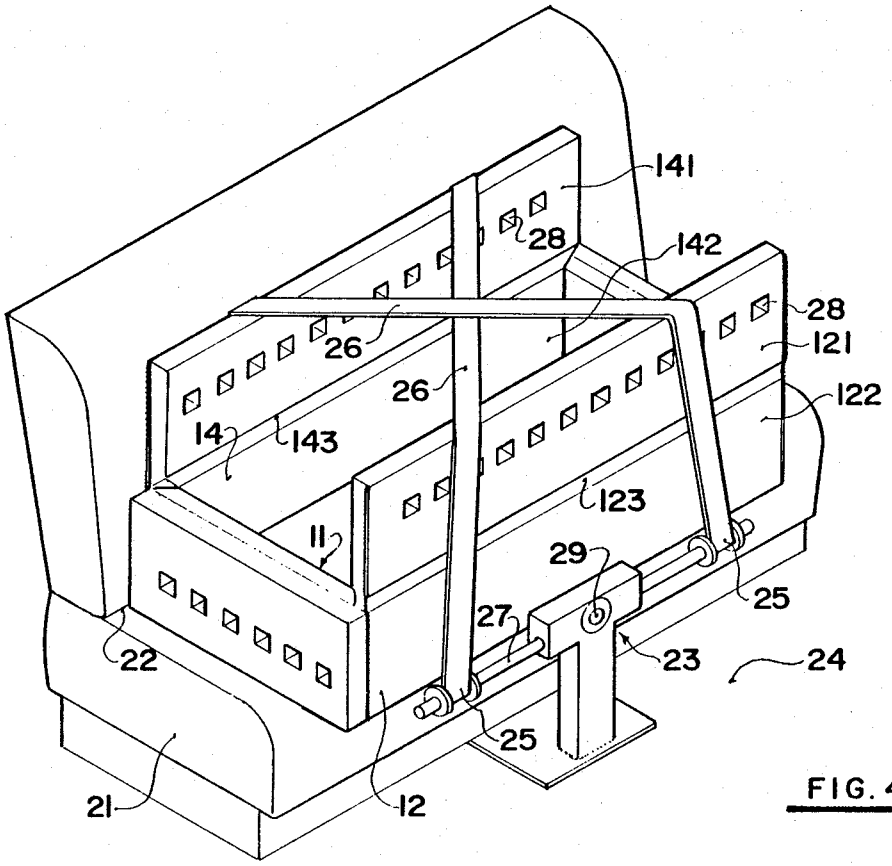
FIG. 4 is an isometric view showing the inflated flat blank from FIG. 1 in suitable condition to provide a safety bed for car transportation of the infant.

Turning now to FIG. 4, the container is shown mounted on a conventional car seat indicated at 21. In this condition of the container, the end walls 11 and 13 are in the folded down position as shown, with the side walls 12 and 14 in the raised position but with the zippers thereof only raised to the fold line 123, 143. The fold lines are arranged so that while they are foldable as previously explained, they also provide sufficient structural strength to retain the upper section of each wall vertical without other support. Thus, with the container placed on the car seat, the upper sections 121, 141 of the walls 12 and 14 are vertically upstanding relative to the car seat so that belts from a position at the junction of the car seat indicated at 22 can pass over the top of the container from the top of the wall 14 to the top of the wall 12 and the downwardly to a retraction mechanism generally indicated at 23 mounted on the floor indicated at 24 of the car. The retraction mechanism includes buckles 25 for attachment to the belts indicated 26 so that in a first condition of the belts they are tightened over the top of the upstanding walls 12 and 14 to generally retain the container in a fixed position on the seat.

The retraction mechanism generally indicated at 23 includes a conventional inertia-sensing device similar to that used in conventional inertia-reel seat belts so that when the vehicle is accelerated or decelerated beyond a certain rate, the retraction device is actuated to draw in the belts 26, e.g. by rotation of a shaft 27 on which the buckles 25 are mounted. The retraction of the belts 26 causes them to draw down across the top of the container thus pulling the upper section 141 of the wall 14 forwardly over the container and the upper section 121 of the wall 12 rearwardly over the container to effectively fully enclose the container and close the open top through which access can normally be had to the child. Thus the container is closed and provides a completely surrounding soft impact-resistant casing around the child to prevent escape and damage to the child. In view of the fact that the container could remain closed for a period of time, ventilation openings 28 are provided in the upper sections 121, 141 of the walls 12 and 14. The retraction mechanism 23 includes a release button 29 by which the straps 26 can be released to the position illustrated in FIG. 4 or can be released completely so as to allow access to the container to remove the child.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A container having inflatable walls for use as a car bed, crib, playpen and bassinet for a small child, the container comprising a rectangular base and four wall portions each attached to a respective edge of the base, releasable interconnecting means between adjacent edges of the wall portions, each wall portion having transverse fold means thereacross dividing a top section thereof from a bottom section adjacent the base whereby the top section can be folded down to lie alongside the bottom section and releasable interconnecting means between the top section and the base to hold said top section in said folded down position.

2. The invention according to claim 1 wherein said releasable interconnecting means between said wall portions comprise a zipper.

3. The invention according to claim 1 wherein the releasable interconnecting means between said wall portions extends from the base to a top of the wall portions whereby the wall portions can be folded down to form a flat blank in the same plane as the base.

4. The invention according to claim 1 wherein the base includes one or more pockets for receiving ballast material.

5. The invention according to claim 1 including a permanently attached air pump.

6. The invention according to claim 1 including a permanently attached air pump arranged along a top edge of one wall portion whereby when deflated the air pump can be rolled into the deflated container to form a cylindrical body.

7. The invention according to claim 1 wherein the base includes at least one pocket for receiving ballast.

8. The invention according to claim 1 wherein there is provided an air pump permanently attached to said container at a top edge of one wall which is substantially equal in size and weight to a tubular portion at a top edge of an opposing wall.

9. The invention according to claim 1 wherein the top sections include ventilation openings passing therethrough.

10. The invention according to claim 1 wherein the wall portions include vertically oriented inflatable tubes which are interconnected for common inflation.

11. The invention according to claim 1 wherein the wall portions include vertically oriented inflatable tubes and wherein the fold means is defined by a reduction in diameter of said tubes.

12. The invention according to claim 1 wherein the width of the fold means is substantially equal to double the thickness of the wall portions whereby the top section can be folded through 180° relative to the bottom section.

13. The invention according to claim 1 in combination with a car seat belt arrangement, said seat belt arrangement being arranged such that the belts can pass over the top of two opposed wall portions and including retracting means whereby the belts can pull the top sections downwardly such that they bend at said fold means to form a closure for an open top of the container.

* * * * *